US007896317B2

(12) United States Patent
Pavlov

(10) Patent No.: US 7,896,317 B2
(45) Date of Patent: Mar. 1, 2011

(54) CONCERTINA TAPE PRODUCTS CONFIGURED FOR STABLE DEPLOYMENT AND RETRIEVAL

(76) Inventor: Michael V. Pavlov, Bloomington, NY (US)

( * ) Notice: Subject to any disclaimer, the term of this patent is extended or adjusted under 35 U.S.C. 154(b) by 830 days.

(21) Appl. No.: 11/835,761

(22) Filed: Aug. 8, 2007

(65) Prior Publication Data

US 2007/0267615 A1 Nov. 22, 2007

Related U.S. Application Data

(62) Division of application No. 10/959,530, filed on Oct. 5, 2004, now Pat. No. 7,290,756.

(60) Provisional application No. 60/589,668, filed on Jul. 19, 2004.

(51) Int. Cl.
*B21F 25/00* (2006.01)
*E04H 17/02* (2006.01)

(52) U.S. Cl. ..... 256/2

(58) Field of Classification Search ..... 256/1–9, 256/11

See application file for complete search history.

(56) References Cited

U.S. PATENT DOCUMENTS

| | | | | |
|---|---|---|---|---|
| 2,801,080 | A | 7/1957 | See | |
| 2,908,484 | A | 10/1959 | Uhl | |
| 3,070,946 | A | 1/1963 | Kirsch et al. | |
| 3,155,374 | A | 11/1964 | Sieffert | |
| 3,463,455 | A | 8/1969 | Meckel et al. | |
| 3,916,958 | A | 11/1975 | Uhl | |
| 4,367,059 | A | 1/1983 | Stubbins | |
| 4,484,729 | A | 11/1984 | Mainiero et al. | |
| 4,503,423 | A | 3/1985 | Mainiero et al. | |
| 4,509,726 | A | 4/1985 | Boggs et al. | |
| 4,666,129 | A | 5/1987 | Dobson | |
| 4,680,573 | A * | 7/1987 | Ciordinik et al. | 340/541 |
| 4,744,708 | A | 5/1988 | Cochrane | |
| 4,818,972 | A | 4/1989 | Mainiero et al. | |
| 4,906,975 | A | 3/1990 | Casella et al. | |
| 4,915,359 | A | 4/1990 | Cochrane | |
| 4,920,775 | A | 5/1990 | Mainiero | |
| 4,978,943 | A | 12/1990 | Mainiero et al. | |
| 5,074,529 | A | 12/1991 | Mainiero et al. | |
| 5,109,583 | A | 5/1992 | Pavlov | |
| 5,139,234 | A | 8/1992 | Cochrane | |

FOREIGN PATENT DOCUMENTS

| | | |
|---|---|---|
| DE | 1 215 029 | 4/1966 |

OTHER PUBLICATIONS

ASTM International; Annual Book of ASTM Standards; Iron and Steel Products; Mar. 2003; pp. 616-617; vol. 01.06 Coated Steel Products.

* cited by examiner

*Primary Examiner*—Joshua T Kennedy
(74) *Attorney, Agent, or Firm*—Schmeiser, Olsen & Watts LLP

(57) ABSTRACT

A deployment system and associated products utilize a magazine for holding and dispensing the products. The products may have any of a number of internal and external trusses that may be in tension and/or compression for rigidifying the product in selected directions. Thus the product may be shaped to fit a predetermined contour. The magazine may be supported on a deployment vehicle for ease of deployment of the product.

4 Claims, 7 Drawing Sheets

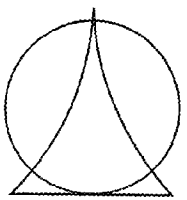
FIG. 6A
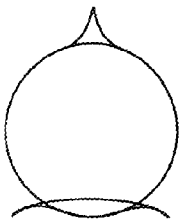
FIG. 6B
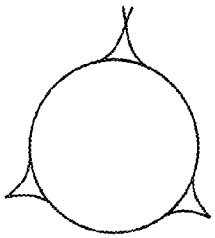
FIG. 6C
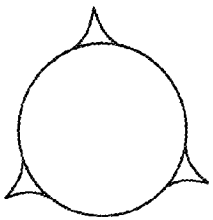
FIG. 6D
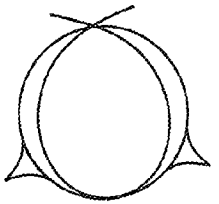
FIG. 6E
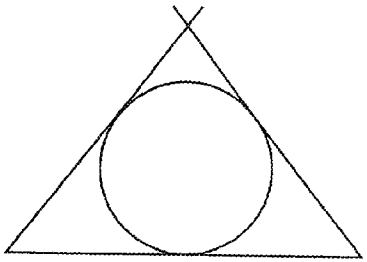
FIG. 6F
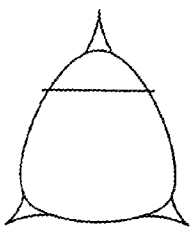
FIG. 6G
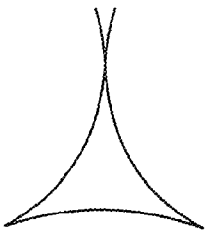
FIG. 6H
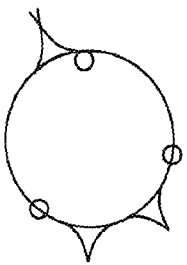
FIG. 6I
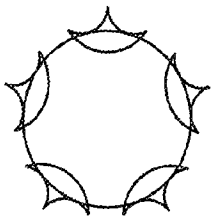
FIG. 6J
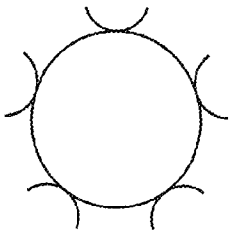
FIG. 6K
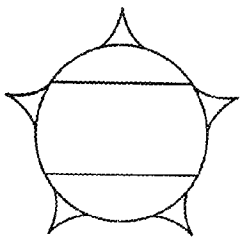
FIG. 6L
FIG. 6M
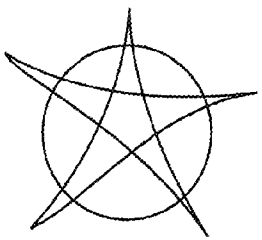
FIG. 6N
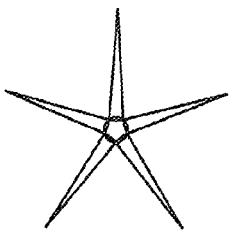
FIG. 6O
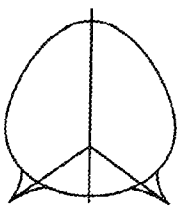
FIG. 6P

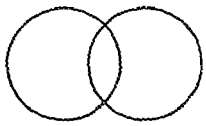
FIG. 7A
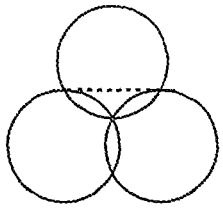
FIG. 7B
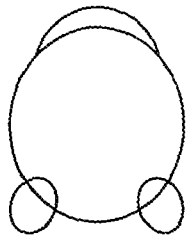
FIG. 7C
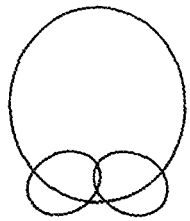
FIG. 7D
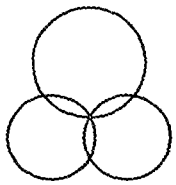
FIG. 7E
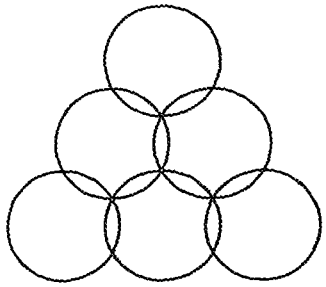
FIG. 7F
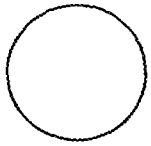
FIG. 7G
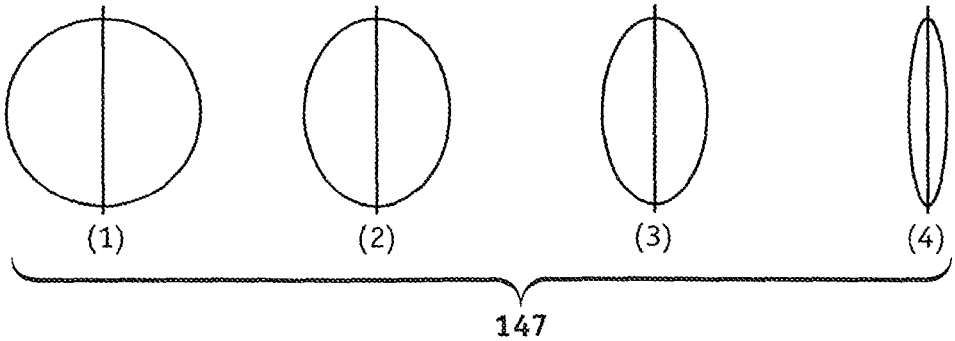
FIG. 8A
150
| | WIDTH (IN) | LENGTH (FT) |
|---|---|---|
| 1 | 74 | 0 |
| 2 | 60 | 650 |
| 3 | 20 | 900 |
| 4 | 0 | 1000 |
FIG. 8B

CONCERTINA TAPE PRODUCTS CONFIGURED FOR STABLE DEPLOYMENT AND RETRIEVAL

This application is a divisional of the U.S. Nonprovisional patent application Ser. No. 10/959,530, entitled CONCERTINA TAPE PRODUCTS CONFIGURED FOR STABLE DEPLOYMENT AND RETRIEVAL and also claims the benefit of U.S. Provisional Patent Application Ser. No. 60/589,668, entitled RAPID DEPLOYMENT BARBED TAPE AND DISPENSER, by the same inventor, filed Jul. 19, 2004, the disclosure of which is incorporated herein by reference.

BACKGROUND OF THE INVENTION

1. Technical Field

This invention generally relates to concertina tape products and systems for stable deployment and retrieval of the products. The present invention specifically relates to a tape product having a concertina coil and at least one of an internal truss and external truss connected to the coil at a plurality of connection points.

2. State of the Art

Barbed tape products are known. Much of the process of making such products has been automated. For example, forming the barbs from a stock tape material has been automated. Also, placement of a reinforcing wire within a channel formed in the tape has been automated. Bending of the product into round coils is also part of known production processes. Efforts to automatically and efficiently clip adjacent strands of product together have been unsuccessful. Accordingly, most manufacturers rely upon manually attaching adjacent strands of the product in a concertina or other desired pattern. Most concertina products have three attachment elements for every two winds (or loops) of the product strand. These elements are generally placed at equally spaced circumferential positions along the product strand. Known barbed tape products seldom purposely depart from this pattern except for between rolls when attaching is suspended, the strand is severed, and the machine is re-threaded for a subsequent roll of product.

Attachment elements, which are generally U-shaped clips with arms that extend from a base and surround a pair of strands are known. In these clips, the arms interleave with each other in an attached configuration. These clips are attached with a clip gun that is typically actuated by a human operator. For convenience, multiple clips are held together in a string by a pair of filaments. The string of clips is fed into the clip gun so that the clip gun may be actuated repeatedly.

DISCLOSURE OF THE INVENTION

The present invention relates to a tape product having a concertina coil and at least one of an internal truss and external truss connected to the coil at a plurality of connection points. The truss may advantageously strengthen and/or stabilize the coil.

A plural coil tape products may include a first concertina coil extending from a first end to a second end of the coil along a first coil axis and at least a second concertina coil extending generally from a first end to a second end of the coil along a second coil axis. The second concertina coil may intersect the first concertina coil in at least partially overlapping side by side relation in a first intersection along the first and second coil axes. The first intersection may comprise a connection of the second concertina coil at more than one circumferentially spaced connection points on the first coil. The product may likewise include intersecting connections to additional coils.

The invention also encompasses a shaped concertina tape product having a concertina coil forming an envelope of a predetermined configuration. The product may include a plurality of trusses connected to the coil. The coil may be thus rigidified against forces in one or more direction so that in a deployed state, an original dimension of the envelope in a rigidified direction is maintained while a dimension in a non-rigidified direction is reduced.

A deployment system for deploying and retrieving a concertina tape product may include a product magazine having at least one base, a stanchion supported on the base, and a latch mounted on the stanchion. The stanchion may have an upright member extending upwardly from a first end of the base and a cantilever support member with a first end connected to the upright member and a second end extending in overlying relation to the base toward a second end of the base. The cantilever support member may have a connection structure at the second end of the cantilever support member for selectively receiving a gooseneck member. The gooseneck member may be removeably connected at a first end of the gooseneck member to the connection structure in one of at least two configurations.

The foregoing and other features and advantages of the present invention will be apparent from the following more detailed description of the particular embodiments of the invention, as illustrated in the accompanying drawings.

BRIEF DESCRIPTION OF THE DRAWINGS

FIGS. 5A-5H, 6A-6P, and 7A-7G are diagrammatic end views of product in various configurations;

FIGS. 8A-8B are a diagram and table showing the narrowing of the width as it relates to the stretch of the product during deployment;

DETAILED DESCRIPTION OF EMBODIMENTS OF THE INVENTION

Figure 1A:
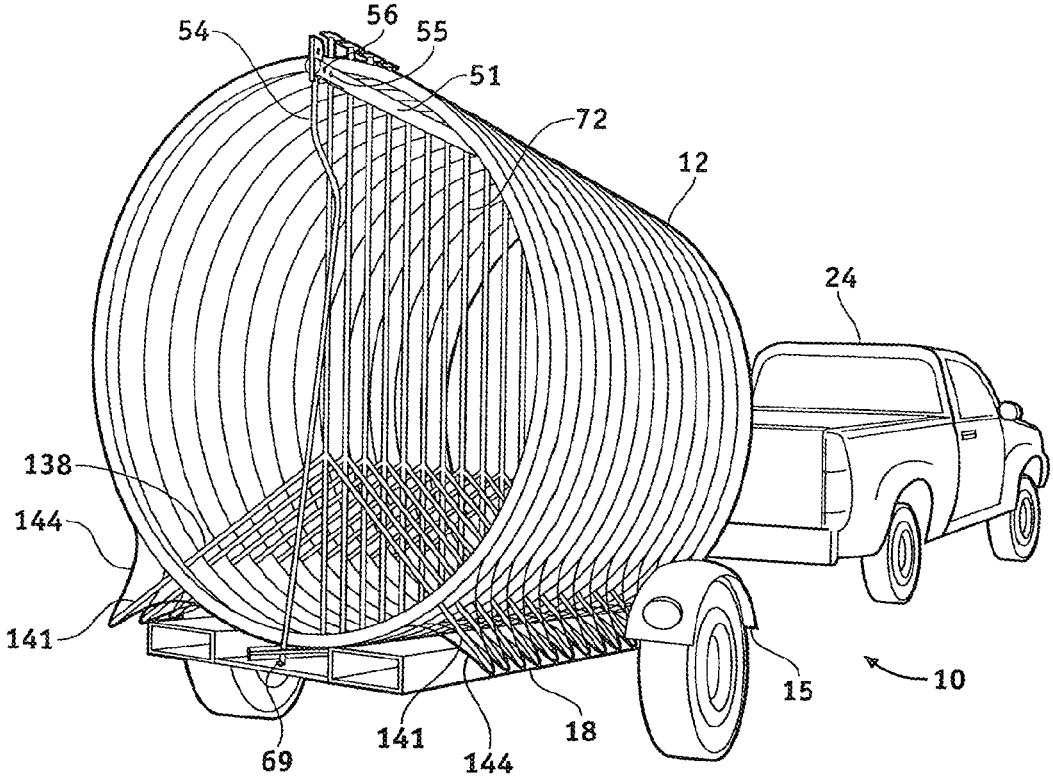
FIG. 1A is a perspective view of the product and magazine on the transport vehicle according to an embodiment of the present invention.
Figure 1B:
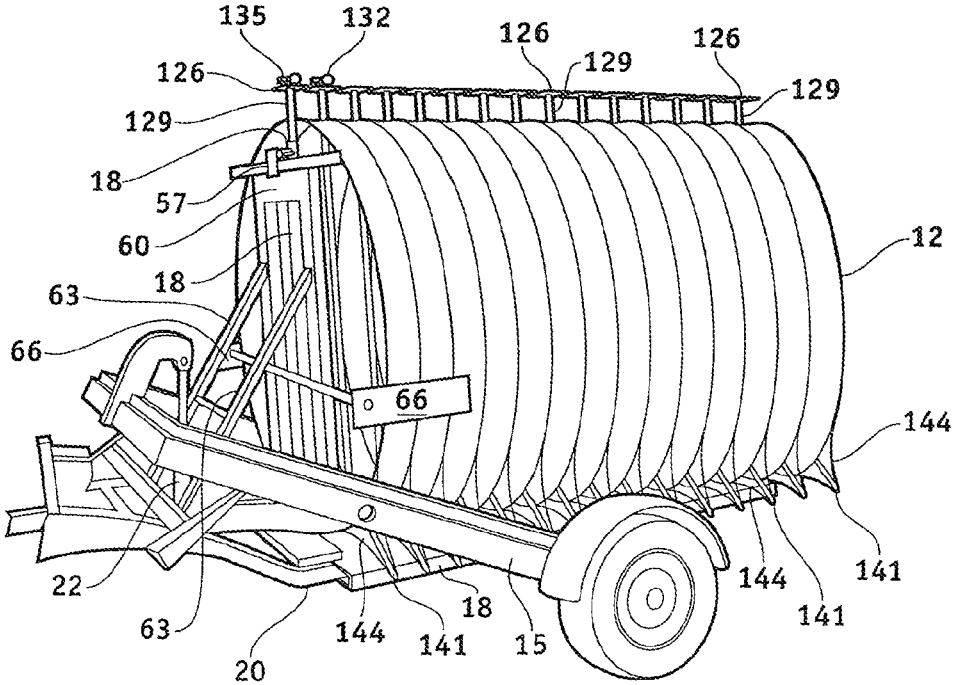
FIG. 1B is another perspective view of the product and magazine on the transport vehicle according to an embodiment of the present invention.

As discussed above, embodiments of the present invention relate to concertina tape products and systems for stable deployment and retrieval of the products. A deployment system 10 with a concertina tape product 12 is shown in FIG. 1A. As shown in FIGS. 1A and 1B, a trailer 15 may be a modified form of an Amaz-N-Tow™ trailer. A magazine 18 for holding the product may be supported on forks 20 of the trailer 15. Thus, the magazine 18 and the product may be raised and lowered as desired by a hydraulic ram before, during, and after deployment and/or retrieval of the product 12. As shown, the trailer 15 may be pulled by a tow vehicle such as pickup truck 24.

Figure 2A:
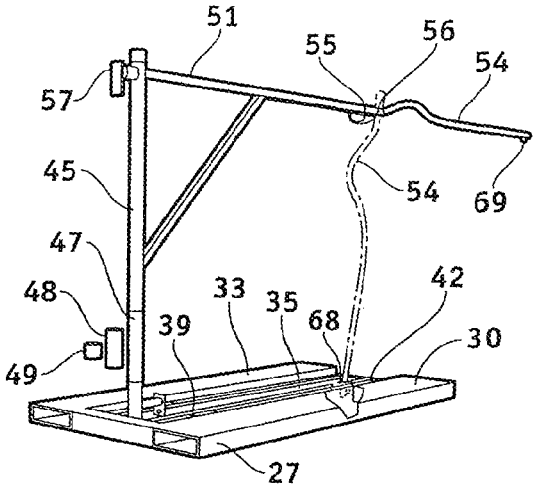
FIGS. 2A-2B are a perspective views of the magazine according to an embodiment of the present invention.

FIG. 2A show the magazine 18 in an unloaded state. The magazine may have a base 27 with two receivers 30, 33 for receiving the forks 20 of the trailer 15. The base 27 may also include a support channel 36 supported on cross bars 39, 42 that extend between the receivers 30, 33. An upright member 45 may be mounted at a first end of the base 27 and may be height adjustable by selectively inserting one of a variety of different height shims 47, 48, 49. A cantilever support member 51 may have a first end mounted on the upright member 45 and extend in overlying relation to the base toward a second end thereof. A gooseneck member 54 may be removeably mounted to the second end of the cantilever support member 51 by first and second pins 55, 56 for selective positioning in one of two configurations. The first configuration is shown in solid lines in FIG. 2A and is a configuration for deployment of the product. The second configuration is shown in dashed lines and is a securing configuration for holding the product on the magazine against inadvertent falling off. A third configuration with the gooseneck member 54 completely removed may be used for retrieving the product and placement thereof on the magazine 18.

Figure 2B:
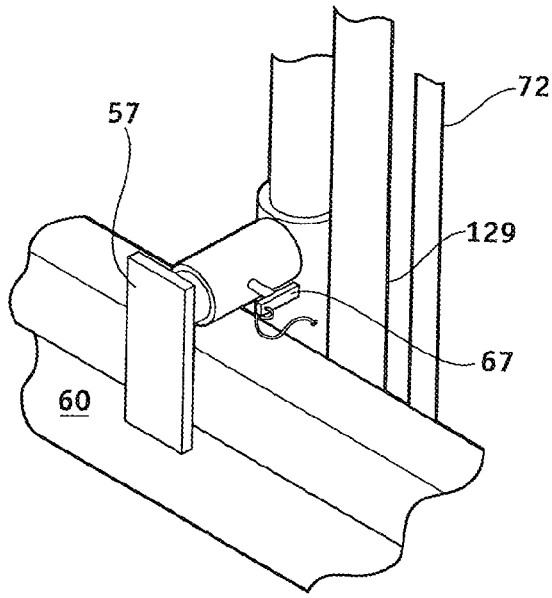

As shown in FIGS. 1B, 2A, and 2B, The magazine 18 may have a latch 57 that releasably connects the magazine 18 to the trailer 15. In this regard, the modification of the Amaz-N-Tow trailer may include tow vehicle upright member 60, upright braces 63, and lateral supports 66, which may be adjustable in a width direction to accommodate coils or rolls of material of different widths. As shown in FIG. 1B, the trailer 15 has been modified to support the magazine 18 at a point near in height to an upper portion of the product 12. This advantageously adds great strength to the magazine and secures it and the product 12 against fore and aft movement as well as side to side movement. The latch 57 may also attach the magazine 18 to the tow vehicle upright 60 near a height of the cantilever support member 51. This configuration transfers loads from the product 12 and the magazine 18 to the tow vehicle upright member 60 and to the trailer 15 when the magazine is held on the trailer 15 by the latch 57 so that an extremely high moment will not be experienced at the connection point of the upright member 45 to the base 27. A pin 67 may be removed from a latch socket to release the latch 57 from a supported condition on the upright member 45 of the magazine 18. Thus, when the latch socket cannot be moved any higher on the upright member 45, such as with the eighty by 64 inch product, the latch may be removed and replaced once the magazine is in an abutting position against the tow vehicle upright member 60.

Additionally, the height of the cantilever support member 51 is approximately seventy-nine inches so that most of the weight of the product engages the channel member 36 via upright members and the product 12 itself. Thus, the force on the cantilever support and the upright member 45 is reduced.

As shown in FIG. 1A and the end view of FIG. 3, the gooseneck member 54 is in the securing configuration. The gooseneck member 54 in this configuration has been removed from the cantilever member 51. A second end of the gooseneck member 54 may be inserted in a keyed through opening 68 in the support channel 36, and rotated by 180 degrees. Then the first end of the gooseneck member 54 may be mounted by a second bolt 56 in the position shown in FIGS. 2A (dashed lines), 1A, and 3. This through opening 68 may be keyed to a protrusion 69 on the gooseneck member 54 that may be inserted through the opening 68 and rotated to inhibit inadvertent falling out of the second end of the gooseneck member 54 from the support channel 36.

As may be appreciated, the product 12 shown in FIGS. 1A, 1B, and 3 is a particular kind of product that includes upright trusses 72. While other products may be supported on the magazine 18, deployed therefrom, and retrieved thereon, the particulars of the product shown in FIGS. 1A, 1B, and 3 are also of importance because they may represent one of the largest diameter products that may be supported and transported on a particular military pallet that is in standard use today. The pallet is the L-463. Furthermore, the product shown may be provided in heights that are taller than the average man. For example, by starting with a coil diameter of approximately seventy-four inches, the vertical height may be extended to eighty inches by using an internal upright truss 72 of eighty-two inches that has a one inch deep notch in each end. A strand of the product may be disposed in each of the notches forcing the product into an oblong configuration that draws the sides inwardly to approximately sixty-four inches. This is advantageous because the product must also be kept within the width limits of the trailer 15. That is, the trailer has a sixty-six inch clearance between the wheel wells in which the product must fit. For the product shown in FIGS. 1A, 1B, and 3 at a height of eighty inches, the width will be sixty-four inches, which has only a small clearance relative to the wheel wells.

Other size requirements relate to fitting the product on the L-463 pallet and include length, height, and width requirements. The length must be no greater than one hundred and three inches, the height must not be greater than ninety-six inches, and the width must be no greater than eighty-eight inches. The product shown and described with regard to FIGS. 1A, 1B and 3 has been substantially maximized to provide a large product that will still meet these requirements. Products of greater or smaller sizes may be provided without departing from the spirit and scope of the invention. However, within these maximum dimensions, the product and the magazine may be supported on the L-463 pallet, airlifted, and dropped to a position of deployment. The modified trailer 15 can also be palletized and dropped to the same position.

Figure 3A:
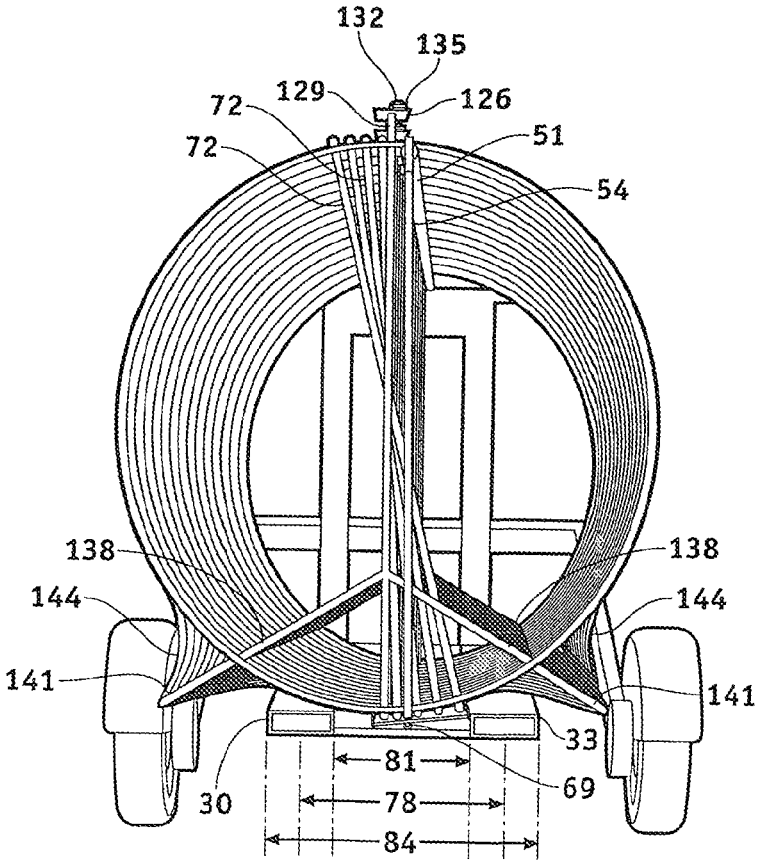
FIG. 3A is an end view of the product and magazine on the transport vehicle according to an embodiment of the present invention.
Figure 3C:
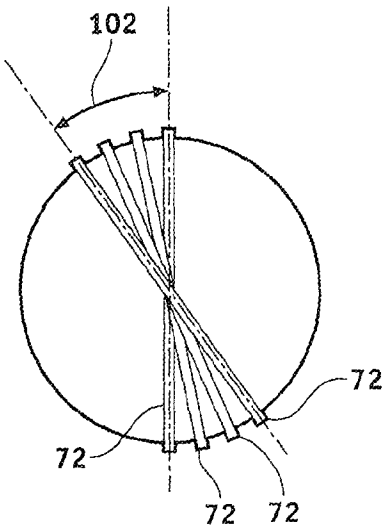
FIG. 3C is a diagrammatic view of uprights of the embodiment of FIG. 3A.

As shown in FIG. 3A, the receivers may be formed of four inch by ten inch rectangular tubing material. These receivers 30, 33 may be spaced from each other to have lateral centers as shown by a dimension 78 that are approximately twenty-six inches apart to mirror centers of the forks 20 on the Amaz-N-Tow. The forks on the Amaz-N-tow are six inches wide and two inches thick. Thus, the forks have a maximum spread of approximately thirty-two inches and a space therebetween of approximately twenty inches. With the receivers 30, 33 each centered twenty-six inches from each other, a tolerance of two inches on each side of each fork 20 and the receivers will be provided. A range of minimum to maximum spread for the openings of the receivers 30, 33 may thus be from approximately sixteen inches to approximately thirty-six inches. On the other hand, the magazine may be provided with receivers that are spaced in a range of approximately twelve to twenty inches apart at the narrowest part of the openings indicated by a dimension 81. Similarly, the widest part of the openings indicated by the dimension 84 may be in a range from approximately thirty-two inches to approximately forty inches, as shown in FIG. 3A. The openings could be made larger if so desired for even greater clearance.

Figure 3B:
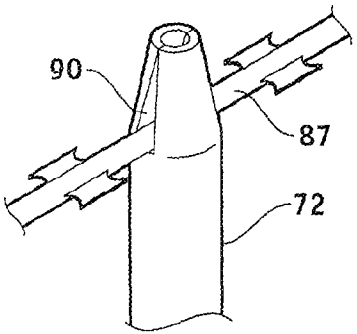
FIG. 3B is a perspective view of a connection of an upright to a strand of product.

The upright trusses 72 may be fixed to strands 87 of the product 12 at upper and lower portions of the coil by placement of the strands 87 in a notch 90 and crimping of the notch closed on the strands 87 as shown in FIG. 3B. This crimping has the advantages of keeping the strands from inadvertently coming out of the notch, and also prevents shifting of the upright trusses 72 along the strand. As shown in FIG. 3A and in the analogous diagrammatic view of FIG. 3C, the upright trusses are oriented in a range from approximately vertical to approximately thirty degrees to the left of vertical. This orientation of the upright trusses 72 is to accommodate precession that will occur during deployment.

Figure 3D:
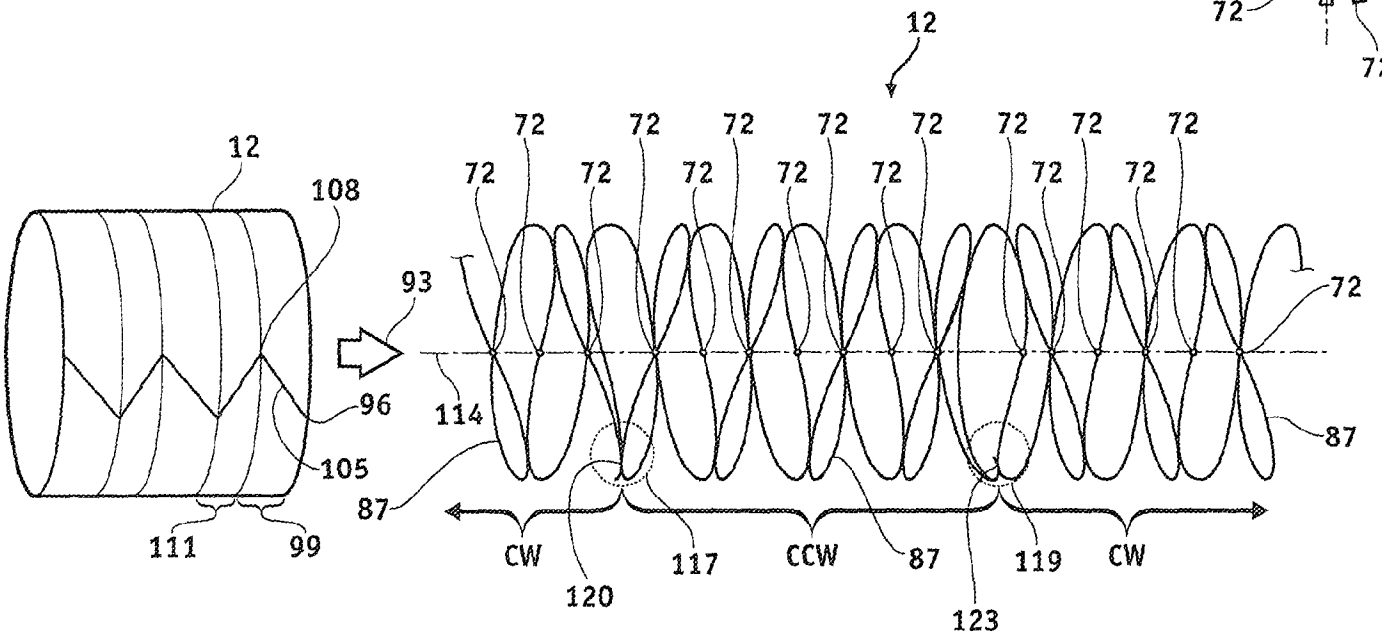
FIG. 3D is a diagrammatic view depicting the relation between counter-rotating and precessing.

When deploying the product, the payout process is accompanied by rotation forces caused by the torsion that is caused as the product is expanded axially and the product moves radially from its largest diameter to a smaller diameter. These rotational forces if unresisted would cause precession of normally axially aligned clips. For example a 60 inch diameter unit with 9 clips would precess one hour (30 degrees). Longer units will precess further. For example, a five hundred foot unit would have a rotation of twelve hours (360 degrees) when deployed. In order for the upright trusses to be generally perpendicular to the ground and any external trusses to lie in a relaxed state when the product is deployed, the truss attachments need to be placed in a counter rotated configuration. This counter rotated form would cause the trusses 72 to extend radially outward from the coil along substantially the entire circumference of a coil and would cause the coil with its trusses to be non-compact. In order to keep any external truss portions in isolated regions of the coil, and in order to maintain the dimensions of the coil within those required as set forth above, the product can be manufactured with sequential segments of the coil having alternatingly clockwise and counter clockwise helically progressive configurations as shown in FIG. 3D.

Where the product 12 in its non-deployed state as shown to the left in FIG. 3D, as the product is drawn from a right end of the coil in the direction of arrow 93, a reference point 96 corresponding to the attachment of the upright truss 72 at an upper portion of the coil and represents the point of maximum rotation during deployment of a first segment 99. To compensate, the upright truss is attached at eleven o'clock and rotates clockwise through an angle of precession 102 shown in FIG. 3C to a twelve o'clock position during deployment. Subsequent upright trusses are counter-rotated less, generally along line 105 in the non-deployed configuration until the point 108 corresponding to the attachment of the last of the upright trusses of the first segment 99. A rightmost reference point of maximum rotation on the next segment 11 will rotate counterclockwise back to approximately eleven o'clock. With additional segments, the same alternating precession occurs for a net of zero precession as indicated by the line 114 having upright trusses disposed generally thereon as shown in the deployed section of product 12 to the right of arrow 93 in FIG. 3D. In this way, the compactness of the product in its non-deployed state may be maintained.

In order to form the coils in clockwise and counterclockwise directions, a table of the bender 90 may be shifted right or left in the bender portion of a system for forming the product 12. The segments are connected to each other in regions 117 and 119. In particular, ends of each segment may be attached to each other in a non-continuous configuration as shown at 120 and 123 in regions 117 and 119. In this way, the segments alternate between clockwise and counterclockwise progressions of the product strands 87.

Some of the trusses 72 may have platforms 126 on upper ends thereof as shown in FIGS. 1B and 3A. Alternatively, stronger uprights 129 may be substituted for some of the upright trusses for the purpose of better supporting the platforms 126 and any components that may be supported thereon, such as lights 132 and/or motion sensors 135 for example. Other components may be mounted thereon, including but not limited to, cameras, transmitters, receivers, and markers. These platforms may be approximately six inches by six inches square to provide a sufficient area to mount electronics or other devices.

FIGS. 1A, 1B, and 3A also show additional trusses. Some of the additional trusses are lateral trusses 138 that are mainly internal trusses that will experience mostly compression forces similar to the upright trusses 72 and 129. These lateral trusses 138 are connected at internal ends to the upright trusses 72 and 129, and may extend downwardly and outwardly to a position exterior of the product coil. External tips 141 may be bend downward to engage the ground in a cleat like manner. The lateral trusses 138 extend to both opposite lateral sides to a position that provides a relatively large base for the product 12. In this way, the product 12 will be stable in a deployed configuration, even when shaped to be tall and narrow. The lateral trusses 138 may be formed of a flat stock or any other suitable material that may be welded or otherwise fixed to the upright trusses 72 and 129.

Others of the additional trusses shown in FIGS. 1A, 1B, and 3A include spurs 144. The spurs 144 may be external trusses that are formed of portions of product that are connected at a first connection to a strand of the coil, doubled over the external tips 141 of the lateral trusses 138, and connected to the strand on an opposite side of the first connection. This arrangement advantageously strengthens and stabilizes the lateral trusses 138. Furthermore, when a barbed tape product is used, the spurs 144 act as a deterrent to those that may attempted to breach or disable the barrier by manipulation thereof via grasping or engaging the tips 141. These spurs form external trusses that may be in tension or compression depending upon the forces applied to them. Under normal circumstances at least a lower extent of a spur 144 will be in tension while the lateral truss 138 that engages the spur 144 will be in compression.

Figure 4:
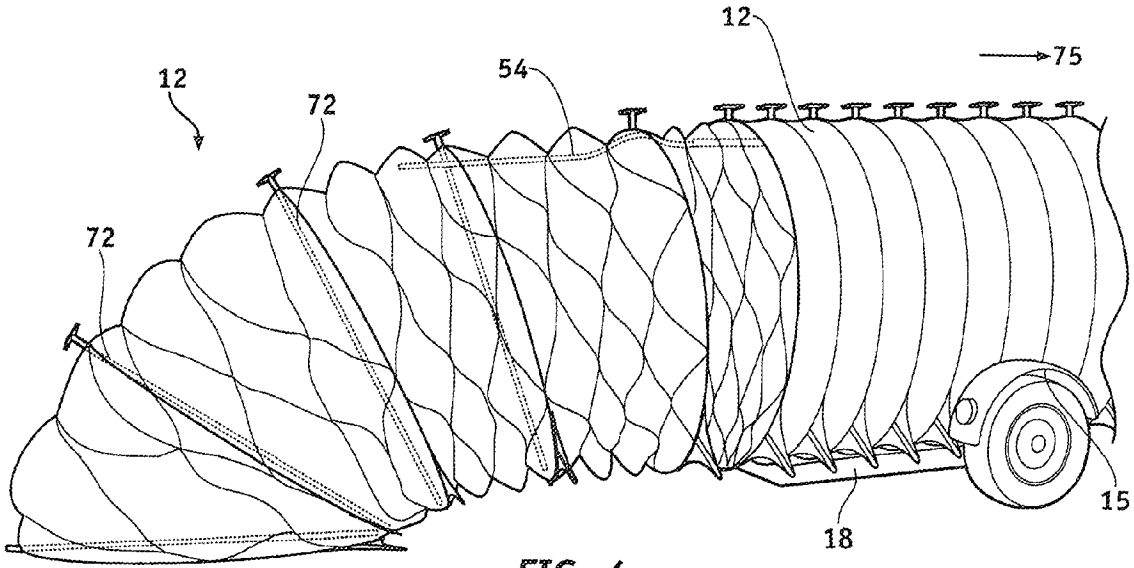
FIG. 4 is a side view of the product being deployed.
Figure 5A:
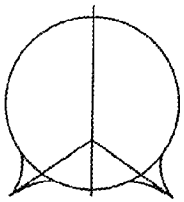
Figure 5B:
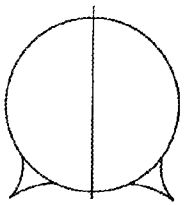
Figure 5C:
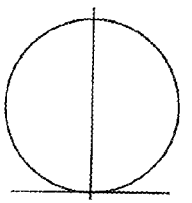
Figure 5D:
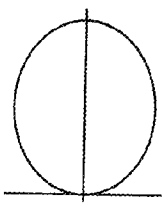
Figure 5E:
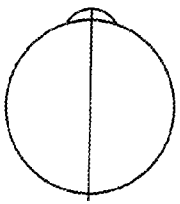
Figure 5F:
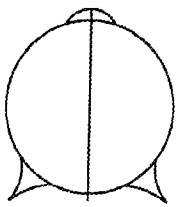
Figure 5G:
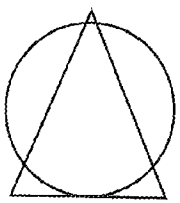
Figure 5H:
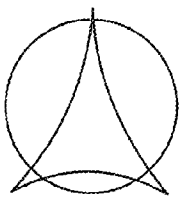

As shown in FIG. 4, the product 12 may be fixed to the ground and the trailer 15 may be pulled in a direction of arrow 75. The deployment capability of the present invention permits the erection of a barrier that can form the perimeter of a military compound, for example, in a very short period of time. A two hundred meter length of product 12 may be deployed from a single magazine 18 in approximately two minutes. This equates to the capability of deploying approximately one quarter mile of product in about four minutes. About one minute is needed to interconnect one coil of product 12 to another coil when one magazine has been emptied and another is to be connected for continued deployment of a barrier. Other products and other diameter coils may be used in conjunction with the deployment system of the present invention. As the height to width ratio of the product increases, the barrier becomes more like a wall than the traditional round barbed tape products of the past. Additionally, the width of the product may be varied over a length of the product to match a particular landscape or a particular urban environment, which may include wide or narrow streets lined by walls or other structures.

Once on site, the product may be deployed in a range from nine hundred to one to one thousand to one man hour ratio improvement for deployment of the eighty by sixty-four inch product. This is due to improved speed in deployment and the requirement of less men to accomplish the task. An improvement of three hundred to one may be achieved with the deployment system for thirty-eight inch and fifty-two inch diameter products as compared with the time and number of men required to deploy these products without the present system. This improvement is due to increased speed of deployment with the vehicle pulling approach, and to the reduced manpower requirement. The products of the present invention may be deployed by a single person. Two men may be used for a measure of improved security through redundancy. Retrieval may be accomplished by backing up the trailer 15. Normally the gooseneck member 54 will be removed during retrieval of the product, and manual placement of the product coil on the magazine may required so that retrieval of the product is more labor intensive than deployment. However, retrieval with the present system is still faster and easier that without. Automatic retrieval may be implemented by a device that has spring loaded fingers that move along a conveyor path, for example.

While the majority of this description has been directed to the eighty by sixty-four inch concertina product, it is to be understood that a large variety of other configurations of concertina product may be implemented with the present system. FIGS. 5A-5H have configurations including a variety of upright trusses, lateral trusses, spurs, and blisters. Some of the configurations do not have lateral trusses or provide them in an alternative form from what has been described with regard to FIGS. 1A, 1B, and 3A above. The variety of trusses shown in FIGS. 5A-5H may be in compression or tension, and may be provided by strands of product, tubular members, flat stock, or other structural members.

FIGS. 6A-6P also have a variety of additional configurations. Once again, these configurations implement a variety of trusses that may be in tension and/or compression. Most of the configurations of FIGS. 6A-6P include a round coiled material similar to those shown and described above. On the other hand, the rounded coils may be shaped by the placement and relative dimensions of the trusses and product coils. For example, FIG. 6G shows a product configuration in which a coil may have been urged into a generally triangular section. FIG. 6H shows a product that was not formed of a coil at all. FIG. 6I shows a configuration that may include one or more of a connected spacer cable, sensor cable, and communications cable, as indicated by the small circles along the periphery of the coil. It is to be understood that such cable may be secured on an interior or an exterior of the product coil. FIG. 6P is a diagrammatic view showing the same configuration as that implemented for the eighty by sixty-four inch product described above. It is to be understood that these configurations may be implemented with any size coils, trusses, and/or other products.

FIGS. 7A-7G include a variety of configurations having intersecting coils. As shown, the intersecting portions form what appear to be petals of flowers. These petal shaped regions advantageously form integral trusses by virtue of stiffening the respective configurations along the intersections. The configuration of FIG. 7B may include a lateral truss as indicated by the horizontal dashed line shown therein. The configuration of FIG. 7E is similar to that of FIG. 7B, but may have a larger upper coil to provide a taller product of more uniform thickness throughout its height. The configuration of FIG. 7F is an example of how the overlap may be extended to a multiple overlap configuration. This advantageous configuration may be extended to any number of overlapping or intersecting coils. FIG. 7G depicts a single coil configuration that may be implemented as a simple concertina product. In this regard, it is to be understood that any of the teachings of the present invention may be combined with an otherwise simple concertina product coil to provide the respective advantages. For example, counter rotating segments of a simple concertina to reduce precession could be implemented with any and all of the configurations shown and described herein. On the other hand, counter rotating may not be needed with plural overlapping product coils since the help to reduce or inhibit precession. It is to be understood that any of a variety of trusses and blisters may be attached to the product including blisters or spurs that are positioned within the roll of product until deployment, at which time they extend outside the envelope of the product. Such blisters or spurs many deploy in an umbrella like action. Further alternatively, a three dimensional blister of spur may be formed by intersecting two or more short strands of product and attaching them to one or more loops of the product.

One of the advantages of an upright truss is shown and described with regard to FIGS. 8A and 8B. In particular, FIG. 8A shows sectional views of deployed products with four respective widths as indicated at 147, even though the heights and the original widths were the same. The progressively reduced width of examples 1-4 is due to elongation of the product in a z-axis direction into the page. As stated above, with the height held constant the width of the product will decrease with increased deployment length. Alternatively expressed, the harder the product is pulled during deployment, the narrower its deployed width will be. Table 150 shows corresponding widths to lengths of deployment. For example, a product like the eighty by sixty-four inch product described above may reach a length of six hundred and fifty feet when stretched until its original sixty-four inch width shrinks to sixty inches. Similarly, the product could be stretched to nine hundred feet, which would yield a twenty inch width. As a practical matter, the product could be stretched to its maximum physical capacities and reach it narrowest possible width and yield a thousand foot length. In this case the width would not actually be zero as indicated in the table 150. However, it would be the practical minimum. On the other hand, the theoretical maximum length would be approximately one thousand four hundred for a completely planar barrier with no width.

Figure 9:
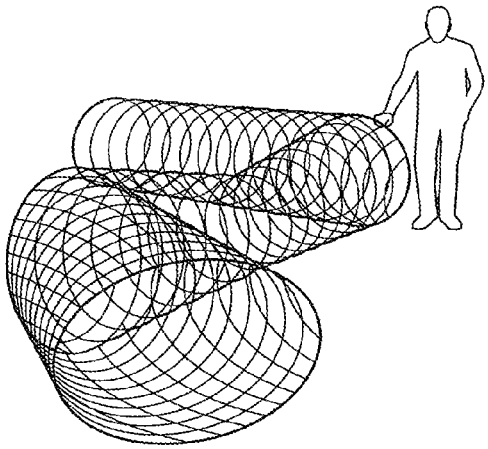
FIG. 9 is a perspective view of a deployed product.

With regard to narrowing a concertina product by stretching, it is to be understood that this and other methods of shaping the configurations of products of the present invention may be implemented. For example, the methods of shaping of copending U.S. patent application Ser. No. 10/959,944, entitled SYSTEM AND METHODS FOR FORMING BARBED TAPE CONCERTINA PRODUCT, by the same inventor, filed Oct. 5, 2004, incorporated by reference, including bending the product around turns, may be implemented with the present invention. In fact, it is to be understood that the product in accordance with the present invention could be deployed quickly with varying predetermined widths, heights, and bends to match a contour on which it is to rest in a deployed state, as depicted by the bending and curving product of FIG. 9. It is to be understood that the coil of material may be trussed for elongation in any direction. For example a wide flat coil may be achieved by a generally horizontal truss that is longer than the natural diameter of the coil. The configuration of the product may be changed along its length, and the shaping may be applied to different products of different sizes.

In some applications, the tow vehicle 24 and the trailer 15 may not fit between obstacles such as buildings, trees, rocks, or other objects. In such cases, an alternative magazine may be implemented. This magazine may be a hand cart 153 similar to that shown in FIG. 9. The hand cart may have a base 156, an upright member 159 that may be height adjustable by selective insertion of shims 162, 165, and 168. A first end of a cantilever support member 171 may be connected to an upper portion of the upright member 159. The cantilever support member 171 may extend in overlying relation towards a second end of the base 156. A gooseneck member 174 may be attached at its first end by a pair of pins 175 and 176 to a second end of the cantilever members, analogously to the gooseneck member 54 described above. However, the hand cart 153 may have a hand grip portion 178 mounted to the upright member as shown in FIG. 10.

Figure 10:
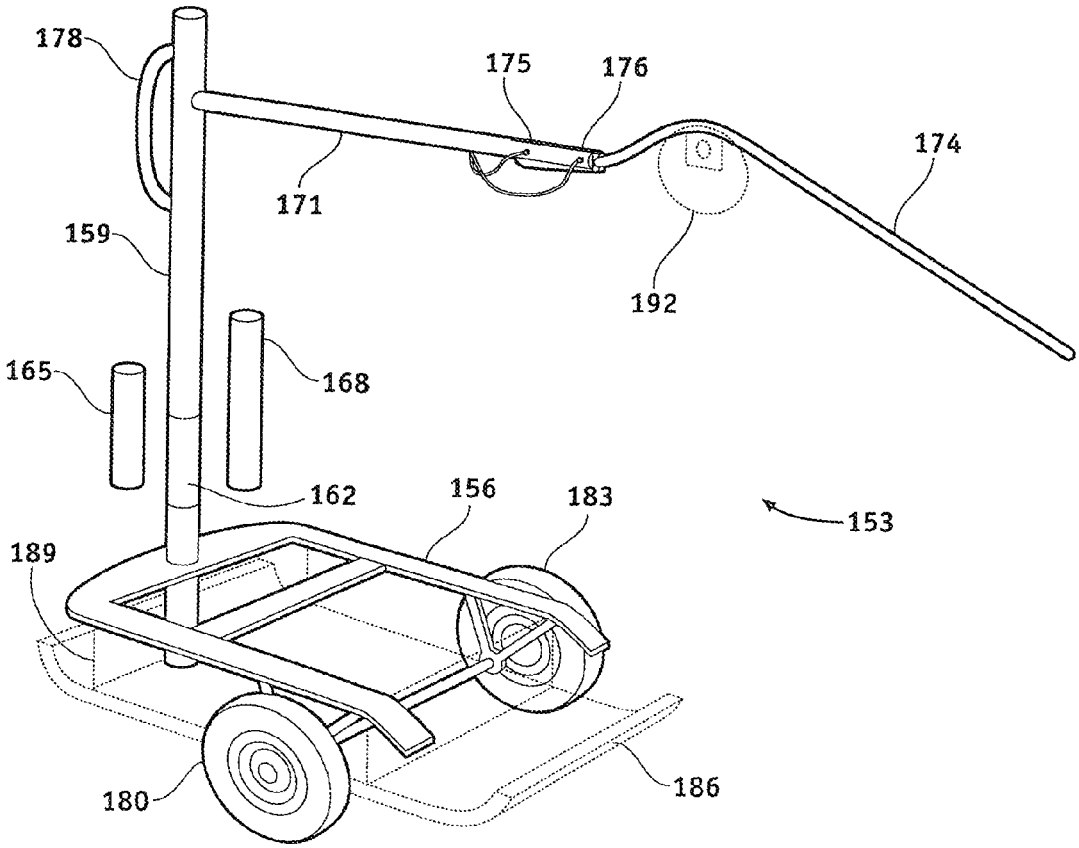
FIG. 10 is an a perspective view of an alternative magazine in accordance with the present invention.

FIG. 10 shows additional features that may or may not be implemented similarly on the magazine of FIGS. 1A-3A. For example, wheels 180, 183 may be provided to facilitate movement of the cart and a product to be carried thereon. The hand cart 153 may be configured for different sizes of product coils. In particular, the hand cart 153 may be capable of supporting thirty-eight inch and fifty-two inch diameter coils on the cantilever support 171 and the base 156. Additional features may further include a skid 186, which may be additionally or alternatively provided with or without the wheels 180, 183. This skid may be selectively deployable such as for environmental conditions that require it. For example, in deep loose sand, in snow, or mud, the skid 186 may prove beneficial. Another feature is a floatation mechanism 189, which may be permanently or selectively available. For example, the floatation mechanism 189 may simply be provided as a light weight buoyant material of relatively constant volume. Alternatively or additionally, the floatation mechanism may be provided as an inflatable enclosure. The floatation mechanism may thus advantageously provide buoyancy to the cart and any product supported thereon in swamps or when fording a stream, for example.

Another feature that may be applied to the hand cart 153 or the magazine 18, is an adjustable eccentric member 192 supported on the gooseneck. This eccentric member 192 may be rotated so that it provides a continuous guide of greater or lesser height for the loops of the concertina product being deployed. In this way, a greater or lesser restriction to passage of the loops off of the cantilevered supports 51, 171 and over the gooseneck members 54, 174 is provided. The result is that the spacing between adjacent loops of the product may be adjusted by raising or lowering the eccentric member 192. In a raised position, the resistance to passage of the product over the gooseneck 54, 174 will be increased. Therefore, the product will be stretched to a greater degree. For the products incorporating upright trusses, this results in narrower with barriers in the deployed state.

Thus, the product may be provided in any of a variety of shaped configurations within a roll or from roll to roll both by varying the clipping sequence as disclosed in the copending U.S. application Ser. No. 10/959,944, entitled SYSTEM AND METHODS FOR FORMING BARBED TAPE CONCERTINA PRODUCT, by the same inventor, filed Oct. 5, 2004, which is incorporated herein by reference. Additionally or alternatively, the product may be shaped by placement of the internal and external trusses described herein. Furthermore, the width of the product may be increased while a height is decreased by placement of a generally horizontal truss in the product. The resulting configuration that may be achieved by a predetermined pattern of trussing and/or clipping may be expressed a dynamic shaping action of the barrier during deployment along a Z-Axis that shapes the envelope in X-Y-directions.

The products herein described may be advantageously benefited by the particulars of the clips used in attaching the product to itself and to trusses. The particulars of copending U.S. Ser. No. 10/959,531 entitled BARBED TAPE PRODUCT WITH A PREDETERMINED PATTERN OF ATTACHMENT POINTS AND ATTACHMENT ELEMENT, by the same inventor, filed Oct. 5, 2004, which is incorporated herein by reference are pertinent. These clips have the advantage of a firm and more rigid attachment that is more stable and results in less misclipping, especially in an automatic clipping operation.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A shaped concertina tape product comprising:

a concertina coil forming an envelope of a predetermined configuration by a plurality of concertina coil segments having respective helically progressive strands, each coil segment having an end connected to an end of an adjacent one of the plurality of concertina coil segments;

wherein the strand of each adjacent segment progresses helically in an opposite rotational direction relative to the adjacent coil segment; and a plurality of trusses connected to the coil to rigidify the coil against forces in one or more direction so that in a deployed state, an original dimension of the envelope in the rigidified direction is maintained while a dimension in a non-rigidified direction is reduced.

2. The shaped concertina tape product of claim 1, wherein the configuration of the envelope has a variety of preselected sectional dimensions along a length of the coil.

3. The shaped concertina tape product of claim 1, wherein the plurality of segments alternatingly comprise respective clockwise and counterclockwise helically progressive strands connected end to end.

4. A tape product comprising:

a concertina coil at least one upright internal truss connected to the coil at a plurality of diametrically opposite connection points, defining a chord of the coil, to strengthen and/or stabilize the coil, the truss comprising a compression member connected at the connection points to portions of the coil which holds the portions away from each other at a predetermined distance; and wherein the truss includes an upright truss connected to the diametrically opposite portions of the coil and at least one additional truss is connected to an additional portion of the coil at one or more of additional connection points.

* * * * *